US006474244B1

(12) United States Patent
Karpinski

(10) Patent No.: US 6,474,244 B1
(45) Date of Patent: Nov. 5, 2002

(54) REFRESHMENT STANDS FOR SWIMMING POOLS

(76) Inventor: Joseph E. Karpinski, 324 3rd St., Carlstadt, NJ (US) 07072

( * ) Notice: Subject to any disclaimer, the term of this patent is extended or adjusted under 35 U.S.C. 154(b) by 0 days.

(21) Appl. No.: 09/621,563

(22) Filed: Jul. 21, 2000

(51) Int. Cl.[7] ..... A47B 23/00
(52) U.S. Cl. ..... 108/42; 108/47
(58) Field of Search ..... 108/47, 48, 42, 108/25, 26, 50.12; 4/496; 44/136; 135/96, 16, 904

(56) References Cited

U.S. PATENT DOCUMENTS

| | | | | | |
|---|---|---|---|---|---|
| 2,246,432 | A | * | 6/1941 | Cohen | 108/47 |
| 3,125,040 | A | * | 3/1964 | Roberson | 108/47 |
| 3,364,882 | A | * | 1/1968 | Merrick | 108/25 |
| 3,425,231 | A | | 2/1969 | Rehrer | |
| 3,624,732 | A | | 11/1971 | Bowden | |
| 4,122,780 | A | * | 10/1978 | Brickman | 108/25 |
| 4,384,857 | A | | 5/1983 | Hoy, Jr. | |
| 4,850,282 | A | | 7/1989 | Postic | |
| 4,893,363 | A | | 1/1990 | Huff | |
| 5,273,468 | A | | 12/1993 | Nichols | |
| 5,333,322 | A | | 8/1994 | Weir | |
| 5,572,750 | A | * | 11/1996 | Johnston | 4/496 X |
| 5,640,911 | A | | 6/1997 | Peters | |
| 5,823,121 | A | | 10/1998 | Reiter | |
| D406,474 | S | | 3/1999 | Toledo et al. | |
| 6,209,147 | B1 | * | 4/2001 | Wheaton | 4/496 |
| 6,253,950 | B1 | * | 7/2001 | Buck et al. | 4/496 X |
| 6,260,566 | B1 | * | 7/2001 | Lafave et al. | |
| 6,276,382 | B1 | * | 8/2001 | Bindschatel et al. | |

* cited by examiner

*Primary Examiner*—Jose V. Chen
(74) *Attorney, Agent, or Firm*—Wolff & Samson

(57) ABSTRACT

A refreshment stand is provided for a swimming pool for providing cold beverages to swimmers in a convenient location wherein swimmers do not have to leave the water to get a beverage. The refreshment stand includes a table which may include cup holders, an umbrella interconnected with the table for providing shade to the refreshment stand, and a cooler interconnected with the table, and accessed through the top of the table for storing cold beverages. The refreshment stand is interconnected to the side of a pool by a support system. For an above-ground swimming pool, the support system includes a supporting arm for supporting the refreshment stand against the outside wall of the pool, and a retaining arm for retaining the refreshment stand on the upper edge of the pool. For an in-ground swimming pool, the refreshment stand can be supported on legs with bases in position along side the edge of the pool. One or more submersible chairs can be utilized in connection with the refreshment stand to provide seating for one enjoying a cold beverage.

10 Claims, 10 Drawing Sheets

REFRESHMENT STANDS FOR SWIMMING POOLS

BACKGROUND OF THE INVENTION

1. Field of the Invention

The present invention generally relates to a refreshment stand for use in connection with a swimming pool and more particularly to a refreshment stand having a cooler, a table surface for holding beverages and/or other items, an umbrella for providing shade to the stand and a support system for utilizing the refreshment stand with an above-ground or in-ground pool.

2. Related Art

A swimming pool is the perfect place to spend a hot sunny day. Often times one finds a pool so enjoyable that one is hesitant to leave unless it is absolutely necessary to do so. Additionally, while in the pool, it is often nice to enjoy a cold beverage. Indeed, there are numerous floating chairs and other devices that have previously been invented which provide cup holders therein so that one can place a cup or can holding a cold beverage. Some pools at resorts even have built in bars wherein one can have drinks without leaving the pool. Such bars are not practicable for home pools.

It is often frustrating for one who spends a significant portion of time in a pool, to exit the pool in order to get a cold beverage. This is particularly true for an above-ground pool wherein one must exit the pool by climbing up one side of a ladder and down the other side of a ladder to climb over the edge of the pool to exit the pool, and on the return, again climb up and over the side of the pool.

Additionally, for one that spends a significant amount of time in a pool, it would be desirable to provide submersible chairs that can be placed into the pool and sat upon so that one could sit on a chair, in the pool, to enjoy a cold beverage. In the past, a suitable solution has not been developed to providing a cooler for storing cold beverages which can be placed at or interconnected with the side of an above-ground or in-ground swimming pool, alone and in connection with a submersible chair for sitting thereon while enjoying a cold beverage.

The present invention, however, addresses this need and provides such a refreshment stand.

Other efforts in this area, and related areas, include the following:

U.S. Pat. No. 5,823,121 to Reiter, discloses a spa table that is self-adjusting in height such that the table-top remains on the surface of the water. The top floats on the water surface. The base includes a show with a hollow interior and a granular material having a density greater than water such that it rests on the bottom of the pool.

U.S. Pat. No. 5,640,911 to Peters, discloses a water and sand table for use by children for play with water and sand.

U.S. Pat. No. 5,333,322 to Weir, discloses an add-on seat module for swimming pools which can be attached to a swimming pool wall having preformed seats that may include hyrotherapy water jets. A support for holding an umbrella is provided. The seats can be attached by a bracket that meets with the swimming pool coping or it can be interconnected with railings or it can be fastened to a pool deck with fasteners such as lags.

U.S. Pat. No. 5,273,468 to Nichols, discloses a marker buoy having a hollow cylindrical chamber with air vent holes for admitting water into the hollow chamber. The device includes an anchor which when it hits the bottom stops the buoy from turning allowing it to fill with water and sink below the surface which turns the buoy from horizontal and locks it into place so that it does not unwind further.

U.S. Pat. No. 4,893,363 to Huff, discloses a hanging wall table for swimming pools for engaging an above-ground pool by a J-shaped hanging support. Suction cups are provided at a low end for engaging the wall and the table engages the frame support. The table has grooves for water drainage and a hole for hanging towels.

U.S. Pat. No. 4,850,282 to Postic, discloses portable food tray supported by two spaced apart vertical frames having a J-shaped upper end for extending over a railing and a horizontal brace for stabilizing the structure.

U.S. Pat. No. 4,384,857 to Hoy, Jr., discloses a submersible floatation structure in the form of a reclining chair wherein water can enter the structure and provide ballast.

U.S. Pat. No. 3,624,732 to Bowden, discloses a beach umbrella tray having a central sleeve for receiving a shaft of the umbrella and a spring for supporting the table against the shaft of the umbrella by friction. Recesses may be provided in the table for receiving various items.

U.S. Pat. No. 3,425,231 to Rehrer, discloses a cage of interconnected hollow pipes forming an air tight chamber mounted on a tank. The chamber and tank have valves for bleeding out air and allowing water to enter or forcing water out. The apparatus can be used by divers.

U.S. Pat. No. Des. 406,474 to Toledo, et al., discloses the design of an immersible pool side chair formed of tubing having an upper J configuration for extending over the side of the pool and a lower support construction and a flexible material interconnected between upper and lower ends to form a seat.

None of the previous efforts in this area, taken either alone or in combination, teach or suggest all of the benefits and the utility of the present invention.

OBJECTS AND SUMMARY OF THE INVENTION

It is an object of the present invention to provide a refreshment stand which is interconnectable with the side of an above-ground swimming pool.

It is an additional object of the present invention to provide a refreshment stand that can be attached to the side of a swimming pool which includes a cooler.

It is an additional object of the present invention to provide a refreshment stand for a swimming pool which includes an umbrella for maintaining the refreshment stand in shade.

It is an additional object of the present invention to provide a refreshment stand which includes an upper surface for placing beverages and/or other items thereon.

It is even an additional object of the present invention to provide a refreshment stand for a swimming pool which includes a table with beverage holders formed therein.

It is a further object of the present invention to provide a refreshment stand for a swimming pool wherein a cooler or a tray can optionally be utilized therewith.

It is a further object of the present invention to provide a refreshment stand for a swimming pool which can be quickly and easily attached to the side of an above-ground swimming pool.

It is a further object of the present invention to provide a refreshment stand for a swimming pool which is easy to assemble.

It is a further object of the present invention to provide a refreshment stand for a swimming pool which can be easily shipped.

It is a further object of the present invention to provide a refreshment stand for a swimming pool wherein the umbrella can be shipped in a flat package, can be easily assembled, and easily placed into an open position.

It is a further object of the present invention to provide a refreshment stand for a swimming pool wherein the umbrella includes a plurality of ribs interconnectable with a support arm for supporting the umbrella in an open position.

The present invention relates to a refreshment stand for a swimming pool for providing cold beverages to swimmers in a convenient location wherein swimmers do not have to leave the water to get a beverage. The refreshment stand includes a table which may include cup holders, an umbrella interconnected with the table for providing shade to the refreshment stand, and a cooler interconnected with the table, and accessed through the top of the table for storing cold beverages. The refreshment stand is interconnected, to the side of a pool by a support system. For an above-ground swimming pool, the support system includes a supporting arm for supporting the refreshment stand against the outside wall of the pool, and a retaining arm for retaining the refreshment stand on the upper edge of the pool. For an in-ground swimming pool, the refreshment stand can be supported on legs with bases in position along side the edge of the pool. One or more submersible chairs can be utilized in connection with the refreshment stand to provide seating within a swimming pool for one enjoying a cold beverage.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

The present invention relates to a refreshment stand that can be attached to an above-ground pool, or placed along side an in-ground pool. The refreshment stands includes a table that can hold a tray or a cooler. The table may include one or more beverage holders. An umbrella can be interconnected with the table for providing shade to the stand.

Figure 1:
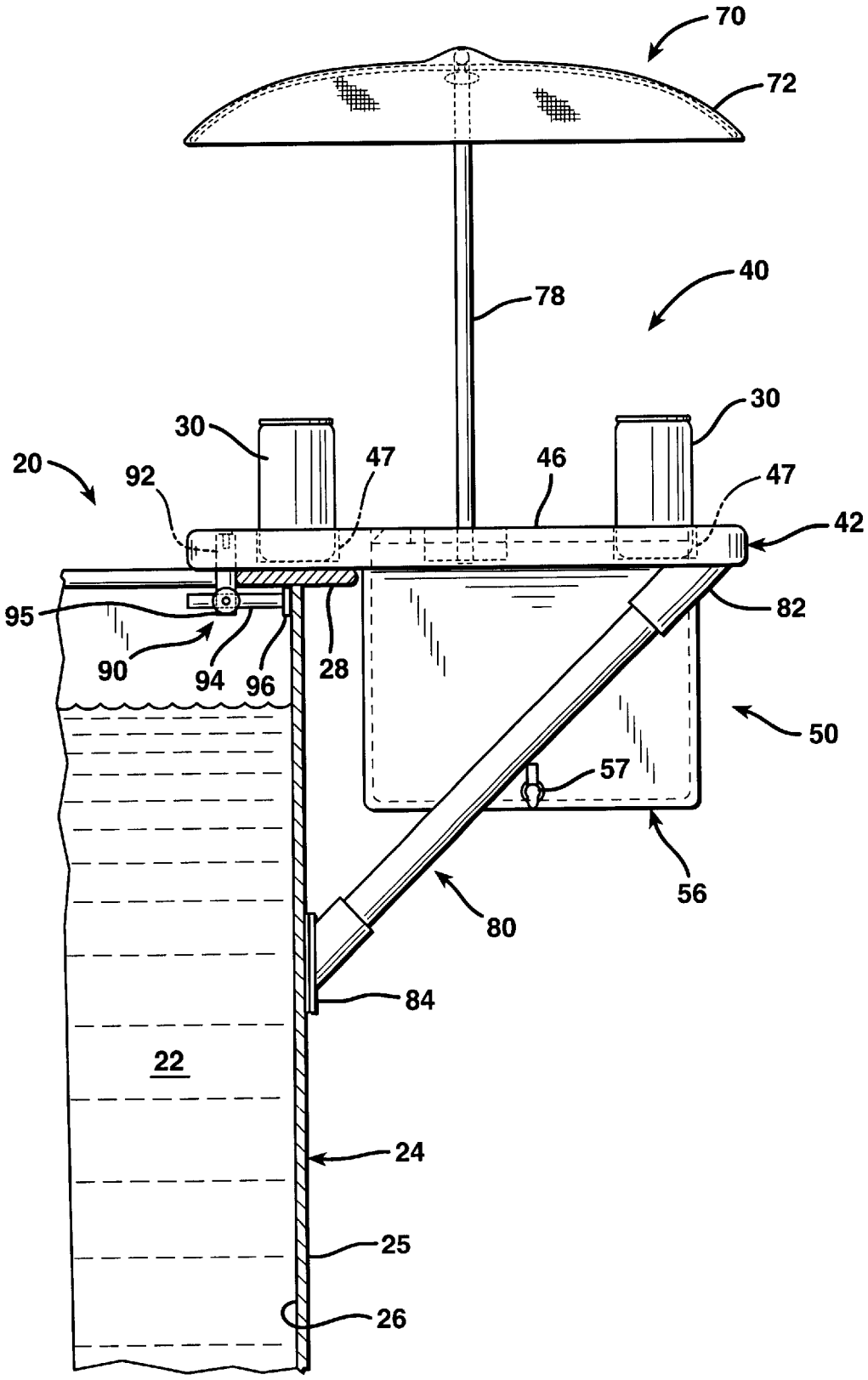
FIG. 1 side plan view of the refreshment stand of the present invention interconnected with a side wall of an above-ground swimming pool.

Referring to FIG. 1, the refreshment stand, generally indicated at 40, is shown attached to a pool, generally indicated at 20. The pool 20 includes a pool wall 24 having an outer side and an inner side. The pool holds water 22. The pool wall 24 has an upper lip 28 which overhangs the pool wall 24 on both the inner and outer sides.

Figure 2:
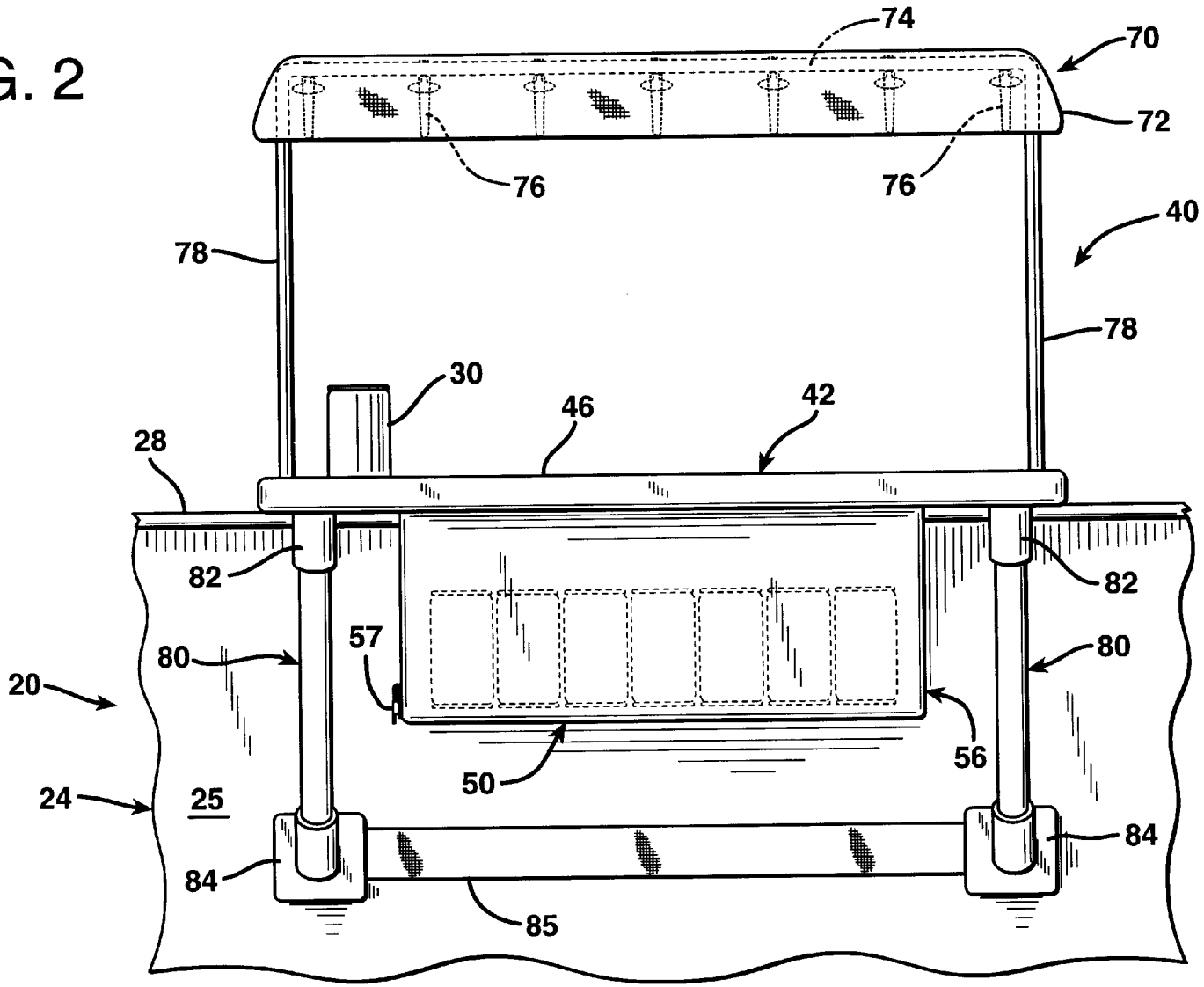
FIG. 2 is a front plan view of the refreshment stand shown in FIG. 1 from the exterior of a pool.
Figure 3:
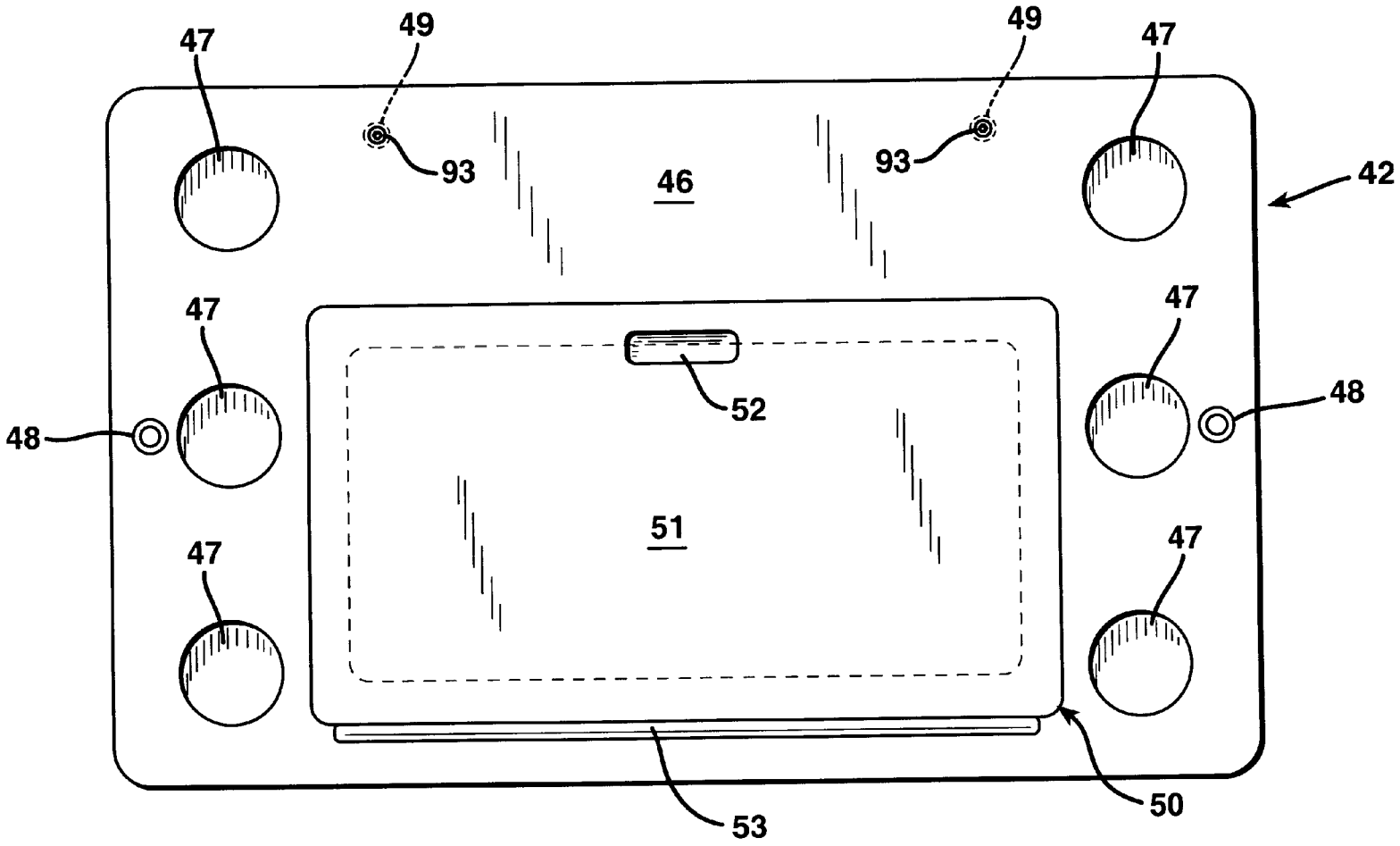
FIG. 3 a top plan view of the table of the refreshment stand shown in FIG. 1.

Referring to FIG. 1 and FIG. 2 which shows the refreshment stand 40 from the exterior of a pool. It can be seen that the refreshment stand 40 includes a table 42. FIG. 3 is a top plan view of the table 40 while FIG. 4 is a perspective view showing the table 40 and components that may be interconnected therewith.

Figure 4:
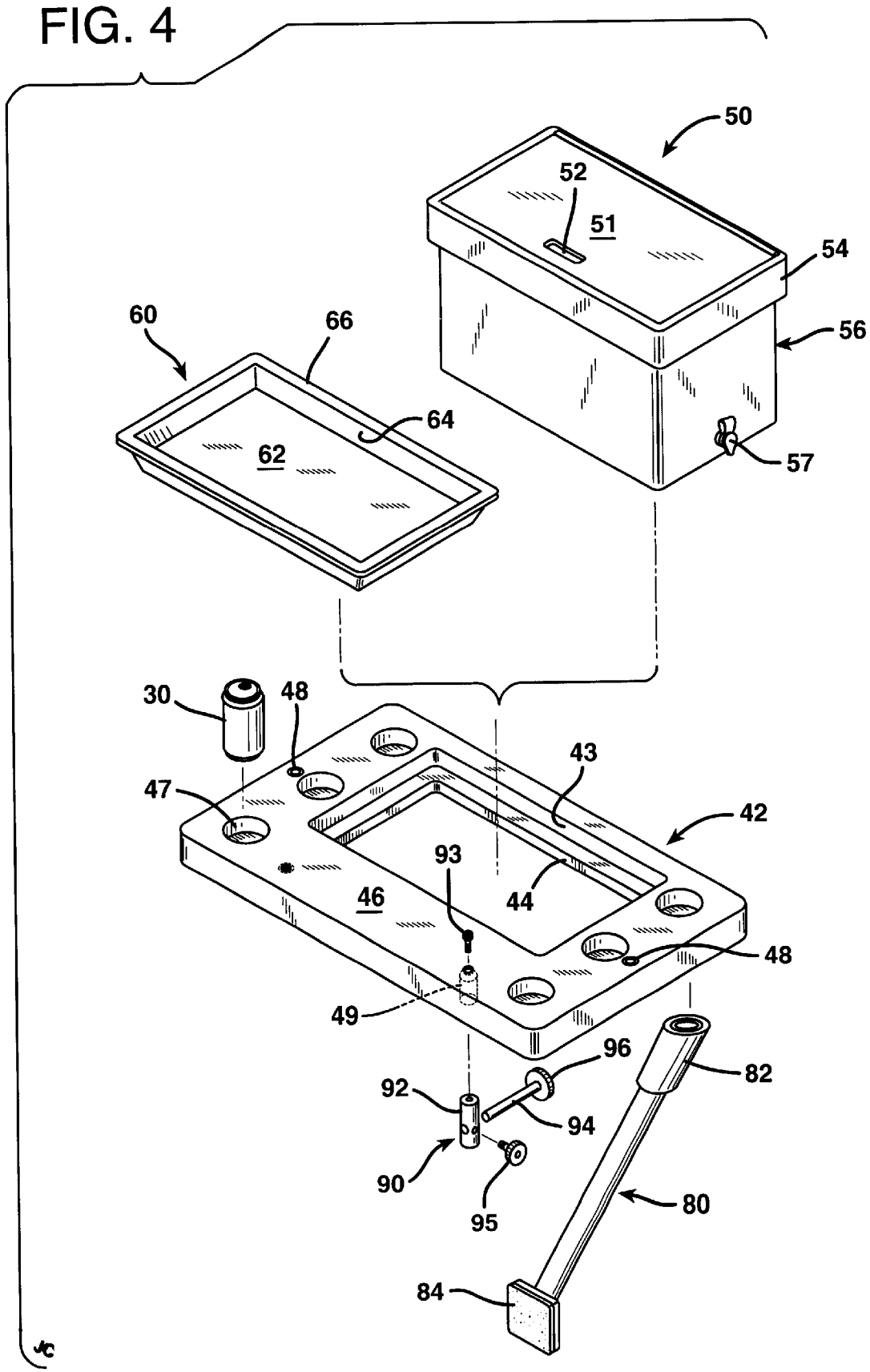
FIG. 4 is an exploded perspective view of the table, support legs and cooler or tray of the refreshment stand shown in FIG. 1.

Referring to FIGS. 3 and 4, the table 42 includes a cooler or tray opening 43 and a cooler or tray support lip 44. The table 42 includes a top surface 46, and may also include one or more cup or beverage holders 47 for holding a beverage container such as can 30. The table 42 may also include one or more umbrella shaft receptacles 48. Interconnectable with the table 42, in one embodiment, is a tray 60 that includes a support surface 62, side wall 64 and lip 66 which coacts with the cooler support lip 44 to retain the tray within the table. In use, the tray may be used for any ordinary purpose.

Alternatively, a cooler, generally indicated at 50, can be inserted into the cooler opening 43 such that the cooler lip 54 engages with the cooler support lip 44 to retain the cooler 50 in the table 42. The cooler includes a cover 51, a handle 52 mounted thereon for opening the cover 51, a hinge 53, a body 56 for holding beverages and/or ice, and a drain spigot 57 for emptying water from the cooler 50. The table 42 also includes leg support apertures 49 which will be hereinafter discussed. As shown in FIGS. 1 and 2, the refreshment stand 40 is engaged with an above-ground swimming pool 20 such that the table 42 is positioned at the upper edge of the swimming pool 20 on the upper lip 28 and extends outwardly therefrom with the cooler 50 overhanging the outer edge of the pool 20.

Figure 5:
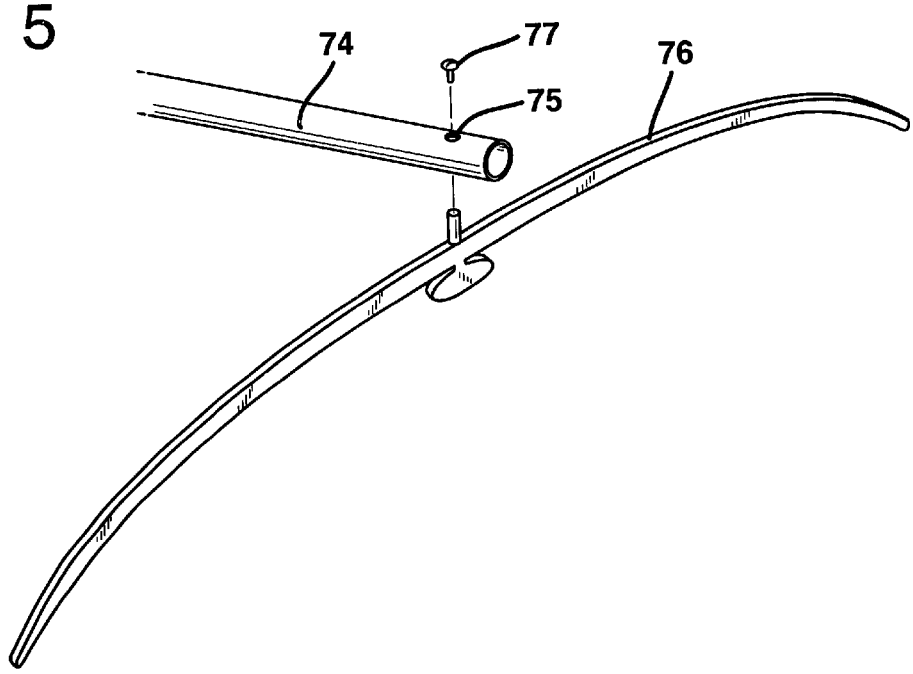
FIG. 5 is a perspective view of the support bar and support ribs for the umbrella shown in FIG. 1.
Figure 6:
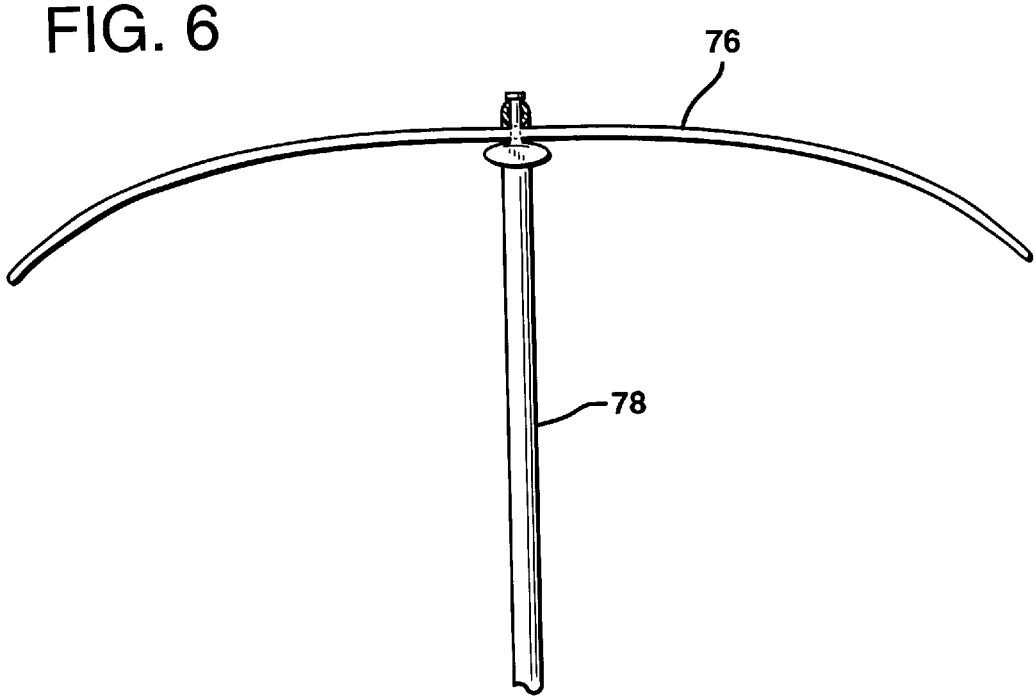
FIG. 6 is a side plan view of a rib and support shaft for the umbrella shown in FIG. 1.

An umbrella generally indicated at 70 can be interconnected with the refreshment stand 40. The umbrella 70 includes a canopy 72 and one or more support shafts 78. As shown in detail in FIGS. 5 and 6, the umbrella 70 further includes a transverse support bar 74 which can extend along the length of the umbrella 70. The transverse support bar 74 includes a plurality of attachment apertures 75 which can receive attachment screws 77 to engage support ribs 76. As such, support ribs 76 can be attached to the transverse support bar 74 and positioned perpendicular thereto, so that the support ribs 76 can support the canopy 72 in an open position. The support shafts 78 interconnect with the transverse support bar 74 at the edges of the transverse support bar 74 as is known in the art. As such, the umbrella 70 can be packaged for shipping in a relatively flat configuration, with the ribs 76 positioned parallel to the support bar 74, and can be easily assembled for use.

Referring back to FIGS. 1, 2 and 4, the support system for engaging the refreshment stand 40 with the above-ground pool 20 preferably includes support legs 80 interconnected with the table 42 at attachment end 82 of support leg 80. The other end of the support legs 80 end at rest plates 84 which contact the outer side 25 of pool wall 24. The attachment end 82 can be attached to the table 42 in any way known in the art. The support leg 80 thereby engages an outer edge of table 42 and extends at an angle to the pool wall 24 to support the weight of the refreshment stand 40 against the side wall 24 of the pool. As shown in FIG. 2, a connection plate 85 may be used to maintain the distance in spacing between support legs 80.

Additionally, as shown in FIGS. 1, 2 and 4, the support system further includes a retention leg, generally indicated at 90, interconnected with an inner side of the table 42. The retention leg 90 extends against the inner side 26 of pool wall 24 and retains the table 42 in position on the pool wall 24. The retention leg 90 includes a vertical portion 92 that extends from the table 42 and is attached thereto by attachment bolt 93. The retention leg 90 also includes a horizontal portion 94 which is interconnected with the vertical portion 92 by means of adjustment screw 95 and which ends in a rest plate 96 which contacts the inner surface 26 of the pool wall 24. The distance that the horizontal portion 94 extends can be adjusted by adjustment screw 95. Accordingly, in use, the support leg 80 supports the weight of the refreshment stand 40 against the outer side 25 of pool wall 24, while the retention leg 90 retains the table 42 against the upper lip 28 on the pool wall 24. Importantly, this support system can be utilized to support a refreshment stand at other locations besides a pool wall, such as, for example, on the side of a deck.

Figure 7:
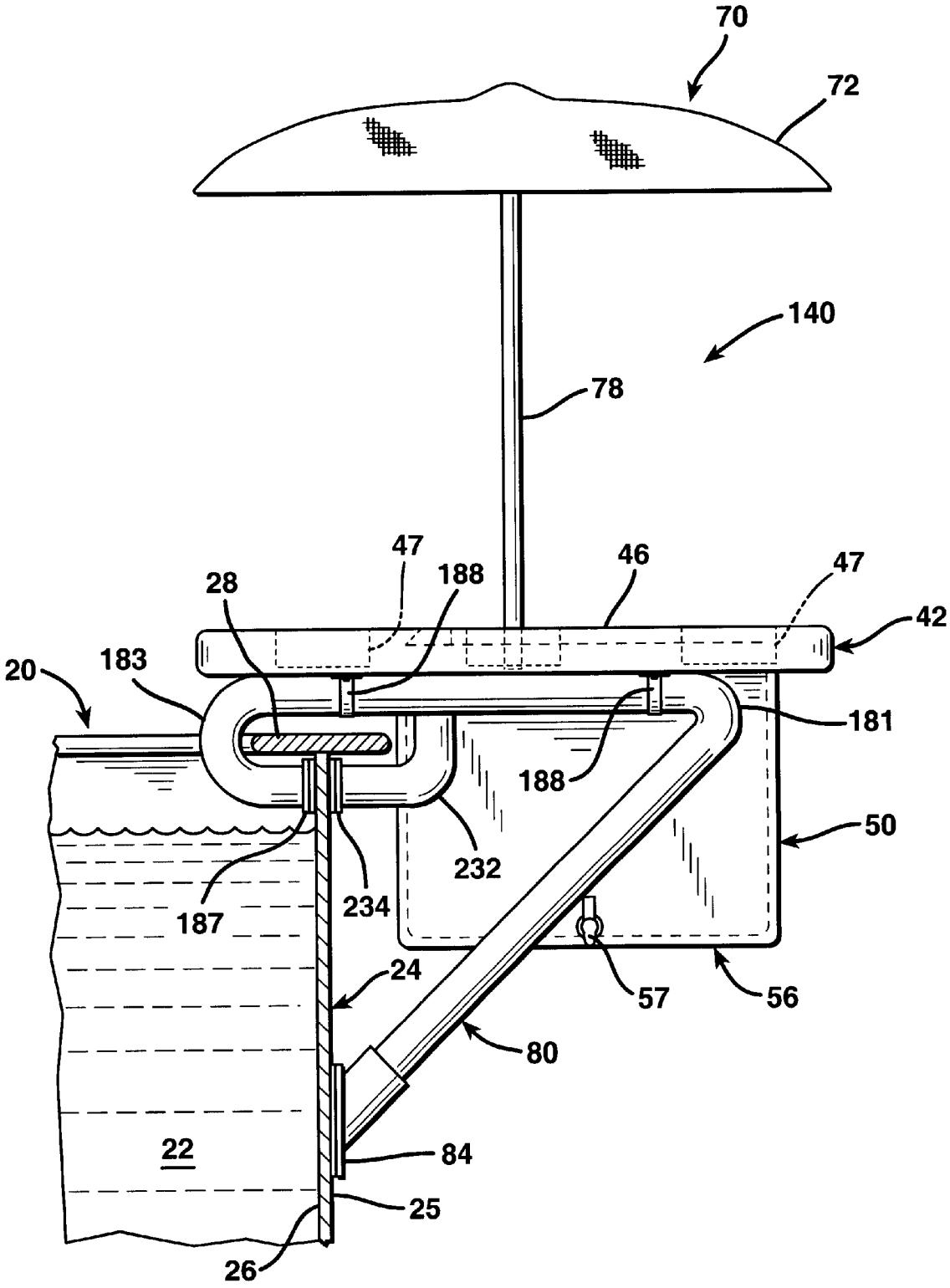
FIG. 7 is a side plan view of another embodiment of the refreshment stand shown in FIG. 1 interconnected with an above-ground pool utilizing an alternate pool attachment system.
Figure 8:
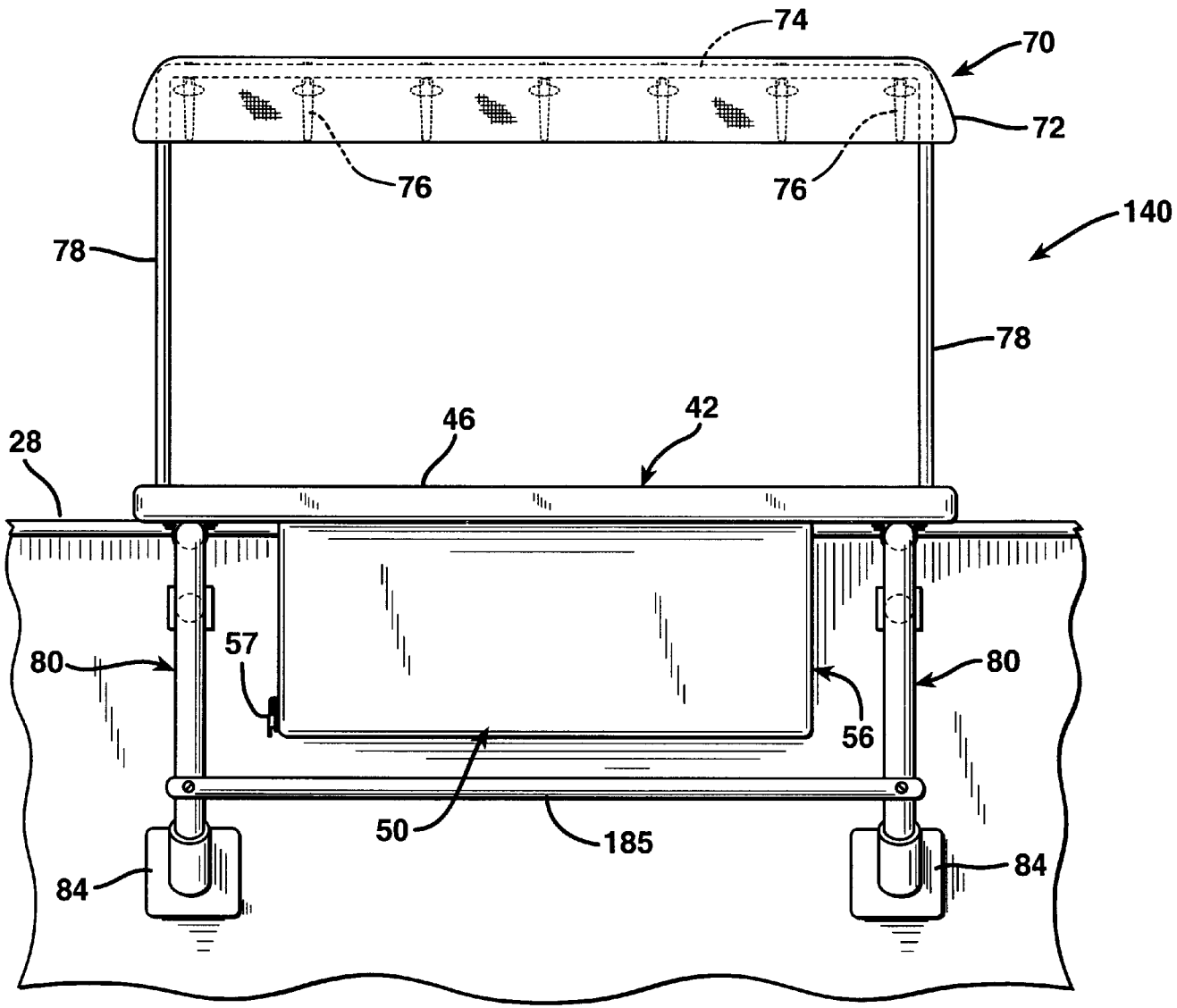
FIG. 8 is a front plan view of the refreshment stand shown in FIG. 7.

Referring to FIGS. 7 and 8, another embodiment of the refreshment shown and generally indicated at 140. In this embodiment, like reference numerals designate like parts of the refreshment stand. The refreshment stand 140 shown in FIG. 7 includes a modified support system wherein the support leg 80 and the retention leg 90 are a single uniform piece wherein the support leg 80 extends to support the refreshment stand 140 against the outer side 25 of pool wall 24 and, instead of ending at the table 42, the support leg 80 bends at 181 and extends parallel to and against the underside of table 42 from the outer to inner sides of the table 42 where it bends down at 183 in u-shape to engage the inner wall 26 of side wall 24 at rest point 187. The support leg 80 is interconnected with the table by brackets 188. An elbow 232 may extend from a central portion of the table 42 and curve down to against the outer side 25 of pool wall 24 and engage same at rest plate 234 to provide an extra measure of security in the attachment. In order to facilitate such a connection, the elbow 232 must be able to be pivot with respect to the table 42 such that it is pivoted out of the way until the support leg 80 engages the pool wall 24 and then is twisted into place. Additionally, the connection plate comprises a support bar 185 which is bolted to the support legs 80.

Figure 9:
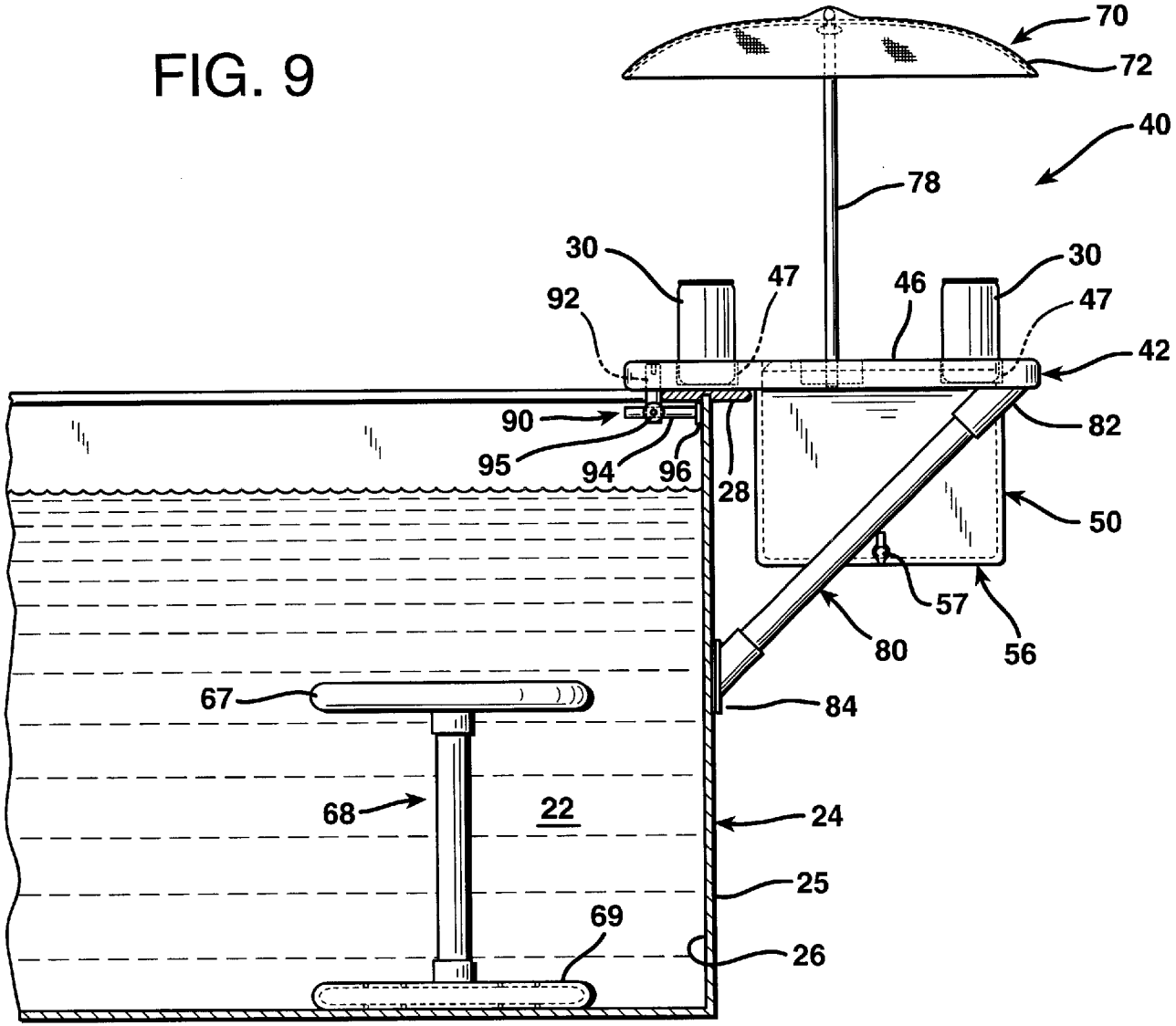
FIG. 9 shows the refreshment stand as shown in FIG. 1 along with a submersible chair.

FIG. 9 shows a refreshment stand shown in FIG. 1 additionally including a submersible chair generally indicated at 68 which can be placed into the pool and used to sit on in the pool. The chair 68 can be made in accordance with what is known in the art so that once put in the pool, the bottom surface 69 sinks to the bottom and the seating surface 67 is facing upward and can be sat upon.

Figure 10:
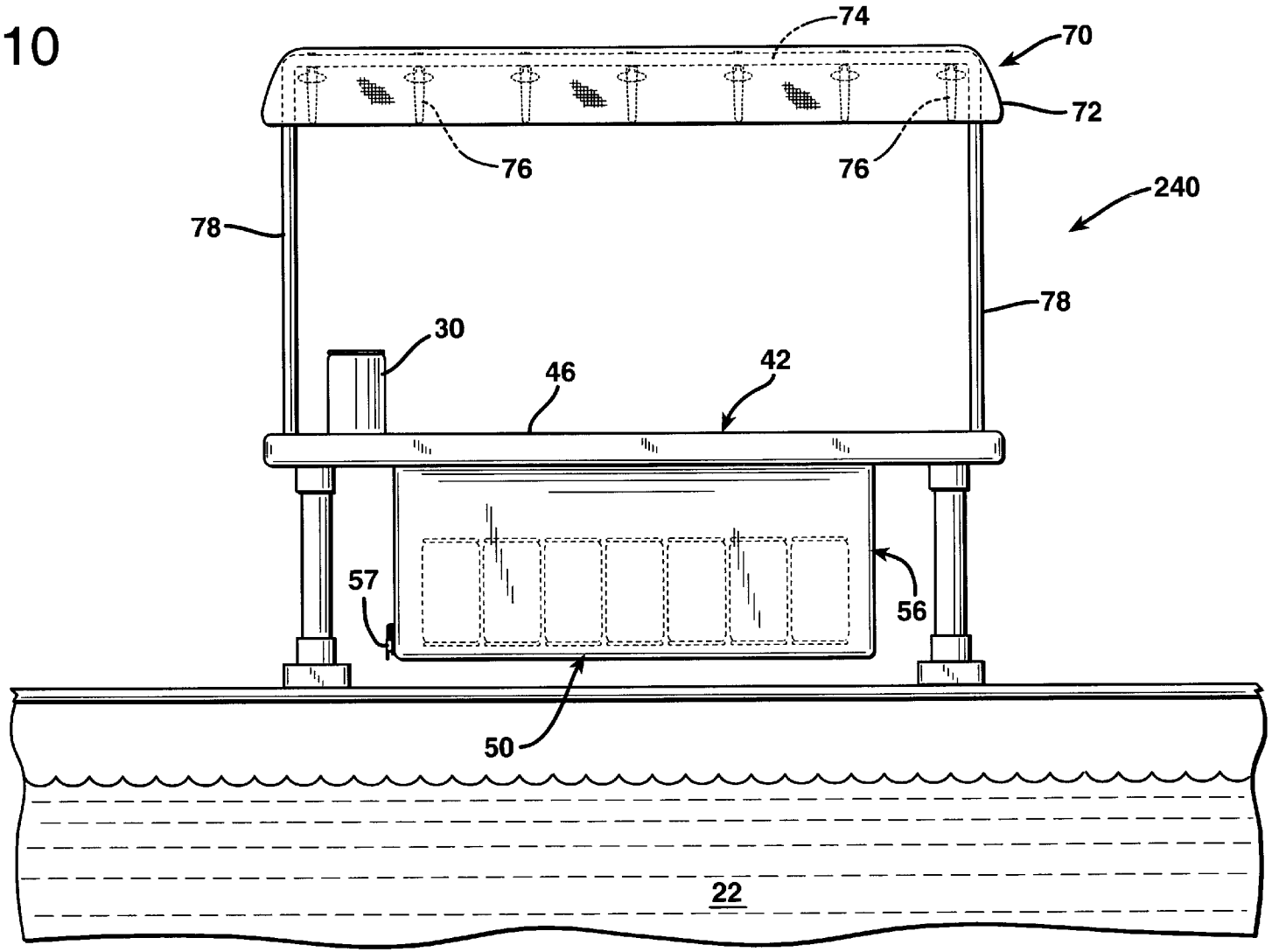
FIG. 10 is a front plan view of an alternate embodiment of the refreshment stand shown in FIG. 1.
Figure 11:
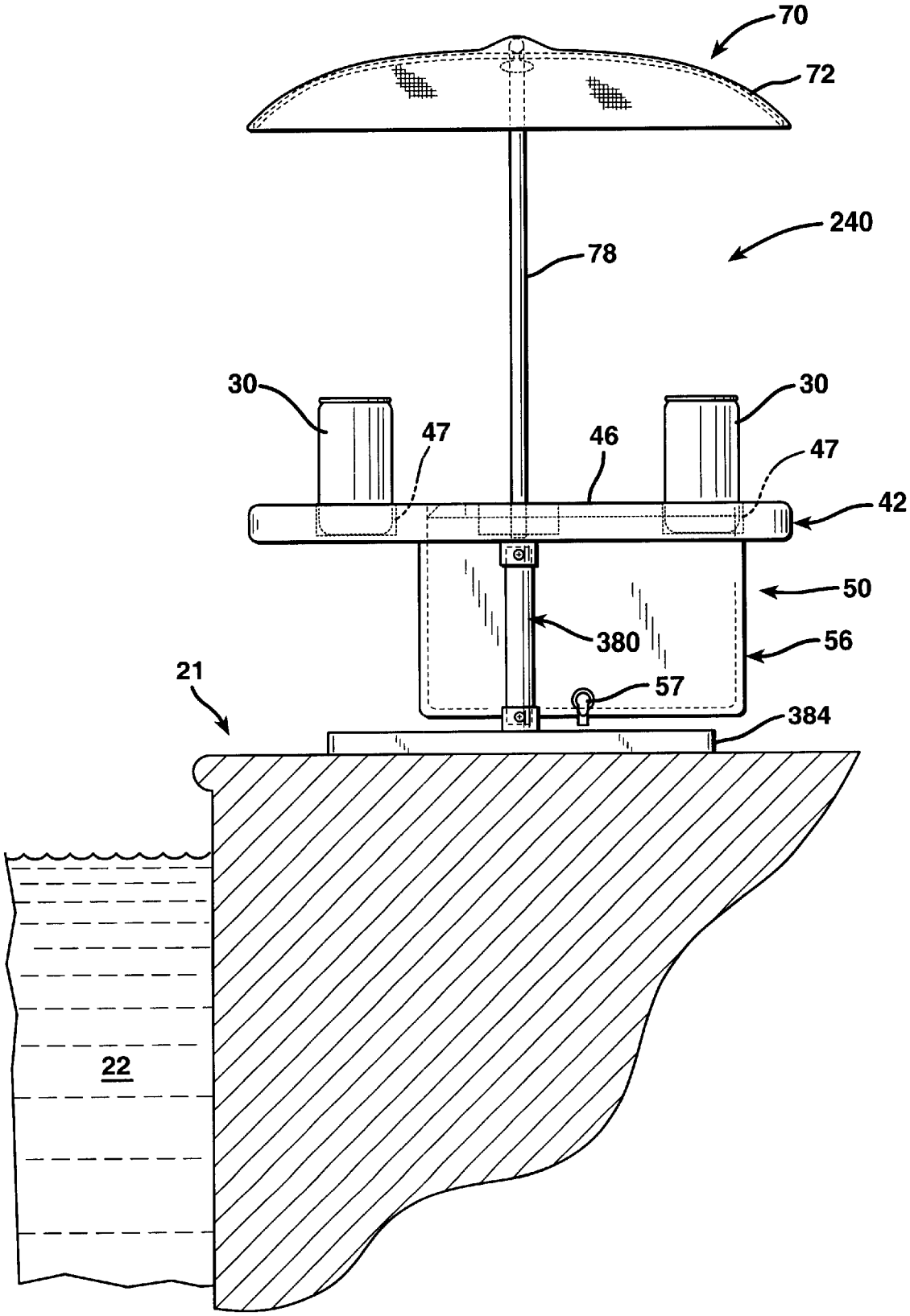
FIG. 11 is a side plan view of the refreshment stand shown in FIG. 10.

FIGS. 10 and 11 show another embodiment of the refreshment stand, generally indicated at 240. Again, similar reference numerals refer to similar elements. In this embodiment, the refreshment stand 240 is configured to be utilized with an in-ground pool generally indicated at 21, and accordingly, the support system is modified. The support system generally includes a support leg 380 interconnected with the table 42 at an upper end, and interconnected with a rest plate 384 at a lower end such that the support bar 380 and the rest plate 384 form a T for supporting the refreshment stand 240 on the ground alongside an in-ground pool.

Having thus described the invention in detail, it is to be understood that the foregoing description is not intended to limit the spirit and scope thereof. What is desired to be protected by Letters Patent is set forth in the appended claims.

What is claimed is:

1. A refreshment stand apparatus for swimming pools comprising:

a table for providing a support surface for resting beverages thereon;

a support system for supporting the table at a location along an exterior side of a swimming pool, the support system comprising a pair of vertical support legs interconnected with a lower side of the table, each support leg attached to a horizontal foot for supporting the refreshment stand apparatus alongside an in-ground swimming pool;

a cooler removably interconnected with and depending from the table, the cooler including a cover forming a portion of the table; and an umbrella interconnected with the table.

2. The refreshment stand apparatus of claim 1 wherein the table includes cup holders.

3. The apparatus of claim 1 wherein the umbrella comprises:

a pair of support shafts, for interconnecting with opposite sides of the table;

a support bar extending between upper ends of the support shafts;

a plurality of support ribs interconnected along the length of the support bar; and a canopy extending over the support bar and support ribs.

4. The apparatus of claim 3 wherein the ribs are rotatable with respect to the support bar from parallel for shipping to perpendicular for supporting the canopy.

5. A refreshment stand apparatus for swimming pools comprising:

a table for providing a support surface for resting beverages thereon;

a support system for supporting the table at a location along an exterior side of a swimming pool, the support system comprising:

a first support leg interconnected at a first end with a lower outer-edge of the table and extending at an angle with respect thereto;

a rest plate interconnected with a second end of the first support leg for contacting an outside wall of an above-ground pool;

a retaining leg interconnected with a lower inner portion of the table, the retaining leg including a horizontal portion extending parallel to the table for contacting an inner wall of an above-ground pool to position the cooler along an outside edge of the pool;

a cooler removably interconnected with and depending from the table, the cooler including a cover forming a portion of the table; and an umbrella interconnected with the table.

6. The apparatus of claim 5 wherein the table includes cup holders.

7. The apparatus of claim 5 wherein the retaining leg includes a first vertical portion and a second adjustable horizontal portion, the horizontal portion terminating in a rest plate for bearing against an inner surface of a wall of an above-ground pool.

8. The apparatus of claim 7 wherein the refreshment stand apparatus further includes a submersible seat for placement in a pool for allowing one to sit thereon.

9. The apparatus of claim 5, wherein the umbrella comprises:

a pair of support shafts, for interconnecting with opposite sides of the table;

a support bar extending between upper ends of the support shafts;

a plurality of support ribs interconnected along the length of the support bar; and a canopy extending over the support bar and support ribs.

10. The apparatus of claim 9, wherein the ribs are rotatable with respect to the support bar from parallel for shipping to perpendicular for supporting the canopy.

* * * * *